US010687593B2

(12) United States Patent
Jones et al.

(10) Patent No.: US 10,687,593 B2
(45) Date of Patent: Jun. 23, 2020

(54) BREATHABLE AND EXPANDABLE RINGS

(71) Applicants: Brighton Jones, Sandy, UT (US); Aaron Dalley, Springville, UT (US)

(72) Inventors: Brighton Jones, Sandy, UT (US); Aaron Dalley, Springville, UT (US)

( * ) Notice: Subject to any disclaimer, the term of this patent is extended or adjusted under 35 U.S.C. 154(b) by 0 days.

(21) Appl. No.: 16/219,956

(22) Filed: Dec. 14, 2018

(65) Prior Publication Data

US 2019/0116946 A1 Apr. 25, 2019

Related U.S. Application Data

(63) Continuation-in-part of application No. 15/706,574, filed on Sep. 15, 2017, now Pat. No. 10,349,709.

(60) Provisional application No. 62/396,962, filed on Sep. 20, 2016.

(51) Int. Cl.
*A44C 9/00* (2006.01)
*A44C 27/00* (2006.01)

(52) U.S. Cl.
CPC ..... *A44C 27/001* (2013.01); *A44C 9/00* (2013.01)

(58) Field of Classification Search
CPC ..... A44C 5/0007; A44C 5/00; A44C 5/0023; A44C 9/00; A44C 9/0053
USPC ..... 63/15, DIG. 3
See application file for complete search history.

(56) References Cited

U.S. PATENT DOCUMENTS

D273,942 S 5/1984 Brueck et al.
6,546,749 B1 4/2003 Canty
D515,965 S 2/2006 D'Annunzio
D516,451 S 3/2006 D'Annunzio
D518,749 S 4/2006 D'Annunzio
D522,902 S 6/2006 Kaplan
7,350,377 B2 4/2008 Kaplan
7,430,879 B2 10/2008 Czajka et al.
D666,362 S 8/2012 Hsu
D750,994 S 3/2016 Baker et al.
(Continued)

FOREIGN PATENT DOCUMENTS

JP 3183612 U 5/2013

OTHER PUBLICATIONS

Bulzi Massaging Comfort Fit Silicone Wedding Ring, for sale on Amazon.com at least as early as Aug. 28, 2015, last visited Aug. 3, 2018, available online at https://www.amazon.com/BULZi-Massaging-Silicone-Comfortable-Flexible/dp/B00ZBQ46UI/ref=sr_1_2?ie=UTF8&qid=1533333654&sr=8-2&keywords=bulzi+ring&dpID=41PKEvYBRwL&preST=_SY300_QL70_&dpSrc=srch.
(Continued)

*Primary Examiner* — Jack W Lavinder
(74) *Attorney, Agent, or Firm* — Law Office of Paul B. Johnson; Paul B. Johnson

(57) ABSTRACT

Rings disclosed herein include a toroid formed of an expandable polymer, the expandable polymer having an elastic modulus of no greater than 5 gigapascals (GPa), the expandable polymer forming at least 80 weight percent of the toroid, the toroid sized to fit snugly over a digit of a user. In implementations a plurality of precious material particles are disposed within the expandable polymer, wherein the precious material particles include one or more of gold particles, non-ionic silver particles, copper particles, platinum particles, and crushed pearl particles. In implementations a plurality of grooves are formed on an inner surface of the ring and extend from proximate a top of the ring to proximate a bottom of the ring. In implementations no portion of the ring has an elastic modulus greater than 5 GPa.

10 Claims, 5 Drawing Sheets

(56) References Cited

U.S. PATENT DOCUMENTS

| | | | | |
|---|---|---|---|---|
| D751,447 | S | 3/2016 | Baker et al. | |
| D751,448 | S | 3/2016 | Baker et al. | |
| D780,614 | S * | 3/2017 | Kaplan | D11/26 |
| D780,615 | S | 3/2017 | Baker et al. | |
| D784,182 | S | 4/2017 | Baker et al. | |
| D789,231 | S | 6/2017 | Baker et al. | |
| D789,232 | S | 6/2017 | Baker et al. | |
| D789,233 | S | 6/2017 | Baker et al. | |
| D789,234 | S | 6/2017 | Baker et al. | |
| 9,943,146 | B2 | 4/2018 | Baker et al. | |
| D863,907 | S | 10/2019 | Little | |
| 2008/0184738 | A1 | 8/2008 | Smarsh | |
| 2011/0289966 | A1 * | 12/2011 | Ahrenholtz | A44C 9/02 63/15.6 |
| 2013/0091895 | A1 | 4/2013 | Hwang | |
| 2014/0083135 | A1 | 3/2014 | Martinez | |
| 2017/0196320 | A1 | 7/2017 | Sato et al. | |
| 2018/0035768 | A1 | 2/2018 | Goodwin | |
| 2018/0206604 | A1 | 7/2018 | Goodwin | |
| 2018/0271233 | A9 | 9/2018 | Goodwin | |
| 2018/0289117 | A1 | 10/2018 | Guirguis | |
| 2018/0289118 | A1 | 10/2018 | Guirguis | |

OTHER PUBLICATIONS

"SteriTouch—The Antimicrobial Specialists," published online at steritouch.com at least as early as Sep. 13, 2016, last accessed Sep. 13, 2016.

"Groove Life Groove Silicone Rings," published online at groovelife.co at least as early as Sep. 13, 2016, last accessed Sep. 13, 2016.

"ShinEtsu Silicone: Characteristic properties of Silicone Rubber Compounds," published by ShinEtsu Jun. 2012, last accessed Sep. 13, 2016.

"SteriTouch All you need to know," published by Steritouch at least as early as Sep. 13, 2016, last accessed Sep. 13, 2016.

Microban online product details, published online by Microban at least as early as Sep. 19, 2016, available online at microban.com, last accessed Sep. 20, 2016.

Groove Life Silicone Ring, published online at https://www.kickstarter.com/projects/381304160/groove at least as early as Apr. 30, 2015, available online at https://www.kickstarter.com/projects/381304160/groove, last visited May 25, 2018 (poor quality of image is how the image was published online, the image is also embedded in the below listed non-patent literature, also submitted herewith).

Groove Ring by Peter Goodwin Kickstarter Campaign, published online at https://www.kickstarter.com/projects/381304160/groove at least as early as Dec. 2, 2015, available online at https://www.kickstarter.com/projects/381304160/groove, last visited May 25, 2018.

"Silicone Wedding Bands—A look at three brands," published online Aug. 23, 2018, available online at https://www.ifjco.com/silicone-wedding-bands/, retrieved Jan. 24, 2020.

* cited by examiner

BREATHABLE AND EXPANDABLE RINGS

CROSS REFERENCE TO RELATED APPLICATIONS

This document is a continuation-in-part application of U.S. patent application Ser. No. 15/706,574, entitled "Breathable, Expandable, and Antimicrobial Rings," which was filed on Sep. 15, 2017, naming as first inventor Brighton Jones, now pending, which in turn claims the benefit of the filing date of U.S. Provisional Patent Application No. 62/396,962, entitled "Breathable Rings," which was filed on Sep. 20, 2016, naming as first inventor Brighton Jones, now expired, the disclosures of each of which are hereby incorporated entirely herein by reference.

BACKGROUND

1. Technical Field

Aspects of this document relate generally to rings worn on the digits of users, such as rings worn on fingers and/or toes.

2. Background Art

Rings exist in the art in a variety of shapes and sizes. Rings are sometimes formed of metallic materials, such as precious metals, and sometimes include gems embedded therein or otherwise attached thereto. Rings sometimes have meaningful significance. For example, one or more rings may be worn to signify that the wearer is married or is engaged to be married. Some rings, however, are worn only for ornamental purposes. Some rings include an inscription, lettering, or other design thereon which may or may not include some type of message—for example the initials of the wearer, or an inspirational message, etc. Rings are commonly worn on the digits of users, such as on fingers or toes.

SUMMARY

Embodiments of rings may include: a toroid formed of an expandable polymer, the expandable polymer having an elastic modulus of no greater than 5 gigapascals (GPa), the expandable polymer forming at least 80 weight percent of the toroid, the toroid sized to fit snugly over a digit of a user, and; a plurality of precious material particles disposed within the expandable polymer; wherein the precious material particles include gold particles, non-ionic silver particles, copper particles, platinum particles, and/or crushed pearl particles; wherein no portion of the ring is rigid.

Embodiments of rings may include one or more or all of the following:

One or more colorants may be disposed within the expandable polymer and visible at an exterior surface of the toroid, the one or more colorants having a color matching a color of the precious material particles, the one or more colorants not including the precious material particles.

The toroid may have a substantially even distribution of the precious material particles interspersed throughout the toroid.

The ring may further incluide shiny particles, wherein the shiny particles are not the precious material particles.

The precious material particles may form between 0.1 and 5.0 weight percent of the toroid.

The precious material particles may not be visible to the naked eye.

The toroid may have a circular cross section defined by two concentric circles.

A plurality of grooves may be formed on an inner surface of the ring and may extend from proximate a top of the ring to proximate a bottom of the ring.

Each groove may be equidistant from its two nearest neighboring grooves, except for two grooves.

The grooves may extend fully from the top of the ring to the bottom of the ring.

In implementations no portion of the ring has an elastic modulus greater than 5 GPa.

Embodiments of rings may include: a toroid formed of an expandable polymer, the expandable polymer having an elastic modulus of no greater than 5 gigapascals (GPa), the expandable polymer forming at least 80 weight percent of the toroid, the toroid sized to fit snugly over a digit of a user, and; a plurality of grooves formed on an inner surface of the ring and extending from proximate a top of the ring to proximate a bottom of the ring; wherein the ring does not have more than one toroid, and; wherein no portion of the ring has an elastic modulus greater than 5 GPa.

Embodiments of rings may include one or more or all of the following:

A plurality of precious material particles may be disposed within the expandable polymer; wherein the precious material particles include one or more of gold particles, non-ionic silver particles, copper particles, platinum particles, and crushed pearl particles.

The toroid may have an elliptical cross section having a constant shape throughout the toroid except at the plurality of grooves.

A majority of the inner surface of the ring may be coplanar with a single curved plane.

The entire ring may be disposed within a single curved plane coplanar with an outer surface of the ring and a single curved plane coplanar with the inner surface of the ring.

Each groove may form a shape of a curved semi-cylindrical cavity.

The grooves may extend fully from the top of the ring to the bottom of the ring.

Embodiments of rings may include: a toroid formed of an expandable polymer, the expandable polymer having an elastic modulus of no greater than 5 gigapascals (GPa), the expandable polymer forming at least 80 weight percent of the toroid, the toroid sized to fit snugly over a digit of a user; a plurality of precious material particles disposed within the expandable polymer, wherein the precious material particles include one or more of gold particles, non-ionic silver particles, copper particles, platinum particles, and crushed pearl particles, and; a plurality of grooves formed on an inner surface of the ring and extending from proximate a top of the ring to proximate a bottom of the ring; wherein no portion of the ring has an elastic modulus greater than 5 GPa.

Embodiments of rings may include one or more or all of the following:

The grooves may extend fully from the top of the ring to the bottom of the ring.

General details of the above-described embodiments, and other embodiments, are given below in the DESCRIPTION, the DRAWINGS, and the CLAIMS.

BRIEF DESCRIPTION OF THE DRAWINGS

Embodiments will be discussed hereafter using reference to the included drawings, briefly described below, wherein like designations refer to like elements.

DESCRIPTION

Implementations/embodiments disclosed herein (including those not expressly discussed in detail) are not limited to the particular components or procedures described herein. Additional or alternative components, assembly procedures, and/or methods of use consistent with the intended breathable rings may be utilized in any implementation. This may include any materials, components, sub-components, methods, sub-methods, steps, and so forth.

As used herein, the word "digit" when it is used in relation to a user, e.g., the "digit of a user" or the like, is defined as a human finger and/or a human toe.

As used herein, the term "precious metal" is defined as one or more of the following metals: gold, silver, copper, and platinum.

Figure 1:
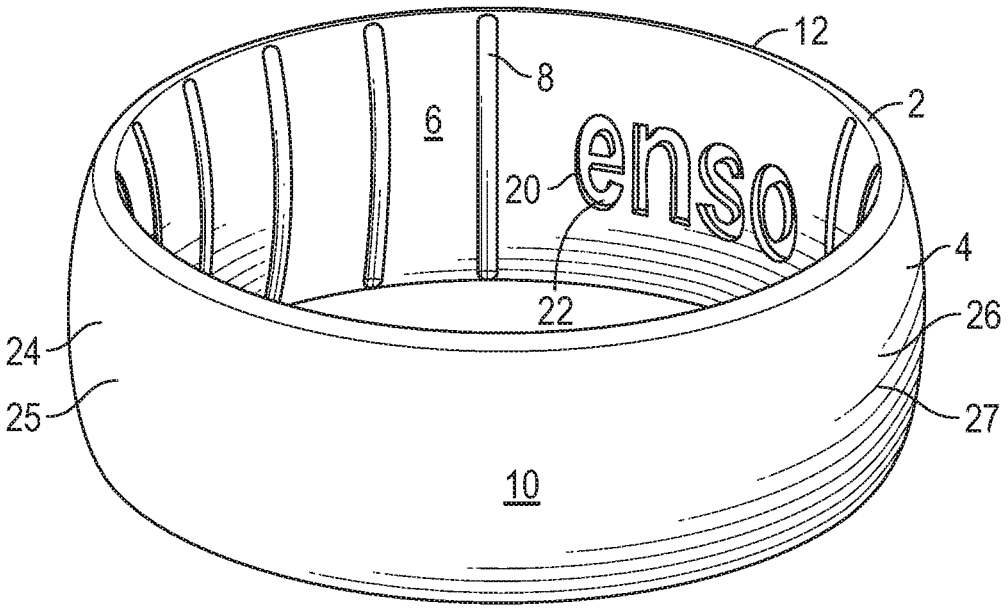
FIG. 1 is a front perspective view of an implementation of a breathable ring.
Figure 2:
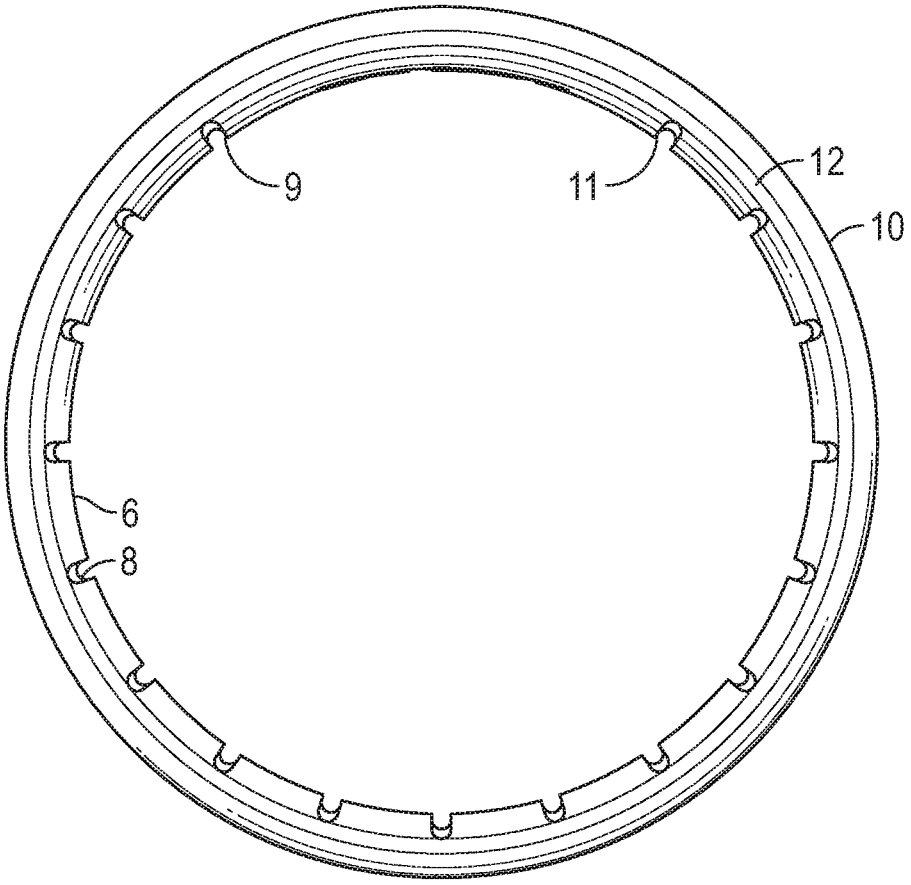
FIG. 2 is a top view of the breathable ring of FIG. 1.
Figure 3:
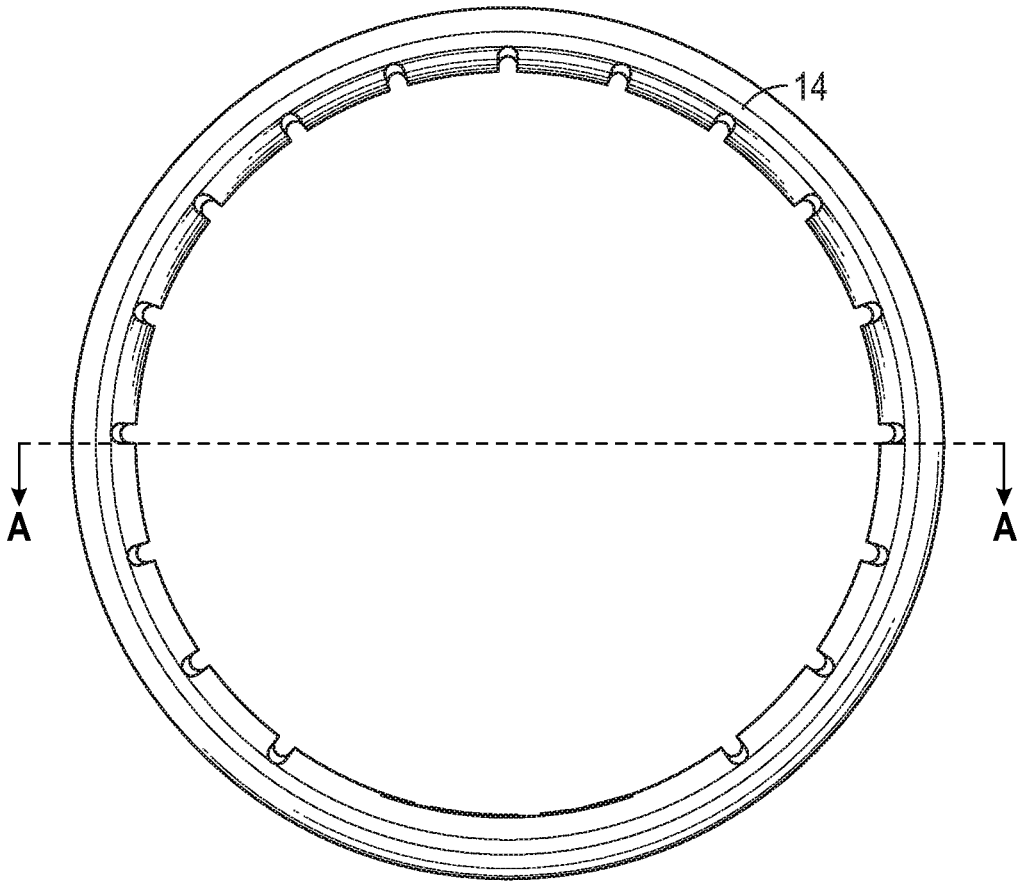
FIG. 3 is a bottom view of the breathable ring of FIG. 1.

Referring now to FIG. 1, a front perspective view of a representative illustration of a breathable ring (ring) 2 is shown. Various views of ring 2 are shown in FIGS. 2-6 as well. FIG. 1 shows that the ring is formed of a toroid 4 and FIG. 5, which is a cross-section of the ring taken along line A-A of FIG. 3, shows that the ring has an elliptical cross-section 16. In other implementations other shapes could be used. By non-limiting example, the ring could have a circular cross-section, an oval cross-section, a square cross-section, a rectangular cross-section, a triangular cross-section, a regular or irregular polygonal cross-section having any number of sides, and any other regular or irregular shape. The cross-section shown in FIG. 5 is seen to be fully solid, having no cavity therein, but in other implementations the ring could have one or more hollow portions, such as forming the shape of a torus or otherwise having hollow channels or cavities therein to affect expandability and the like.

FIG. 1 shows that the ring/toroid has an inner surface 6 and an outer surface 10. The inner surface and outer surface meet at a top 12 of the ring and at a bottom 14 of the ring. On the inner surface a number of grooves 8 are disposed at equal intervals except in a section of the inner surface where an image 20 is located. In the representative illustration the image is an inscription 22 which includes the letters "enso" which is a brand name. In other implementations the image could be something other than an inscription or physical recess, such as a physically raised portion, a color or other design, or the like. The image may be a logo and/or an alphanumeric inscription.

In each representative illustration shown in the drawings (i.e., for all of the rings of FIGS. 1-8) there are seventeen (17) grooves shown. In each case they are shown being equally spaced apart except proximate the location of the image. From FIG. 6 it may be seen that in the representative example over three-quarters (and probably closer to 80-85%) of the inner circle formed by the inner surface has equally spaced grooves therein. This is not to say that the grooves take up 75-85% of the surface area formed by the inner surface—but rather that this portion of the inner surface is characterized by equally-spaced grooves (or in other words has grooves therein) regardless of how much surface area the grooves occupy and that the remaining 15-25% of the inner surface has no grooves therein. Referring to the representative example shown in FIG. 2 there are multiple grooves 8, including a first groove 9 and a second groove 11 and several grooves 8 between the first groove and the second groove, each groove 8 between the first groove and the second groove being equidistant from its two nearest neighboring grooves, and no imaginary line drawn on the inner surface from the first groove to the second groove and intersecting all other grooves in between could span a distance less than 75-85% the full circumference of a circle defined by the inner surface.

It may be understood that while the number of grooves may be modified, in general there are factors that may allow the practitioner of ordinary skill in the art to settle on an appropriate number of grooves. The more grooves there are, for example, the greater the ease with which moisture, dirt, grime, etc., can extract itself or be extracted from between the ring and the digit of the user. The more grooves there are, however, the less surface area there may be contacting the digit of the user, and thus the ring may grip the user's digit less strongly. The expandability of the ring as a whole may also be slightly increased with increased number of grooves. Accordingly, choosing the right number of grooves entails balancing these factors.

Figure 6:
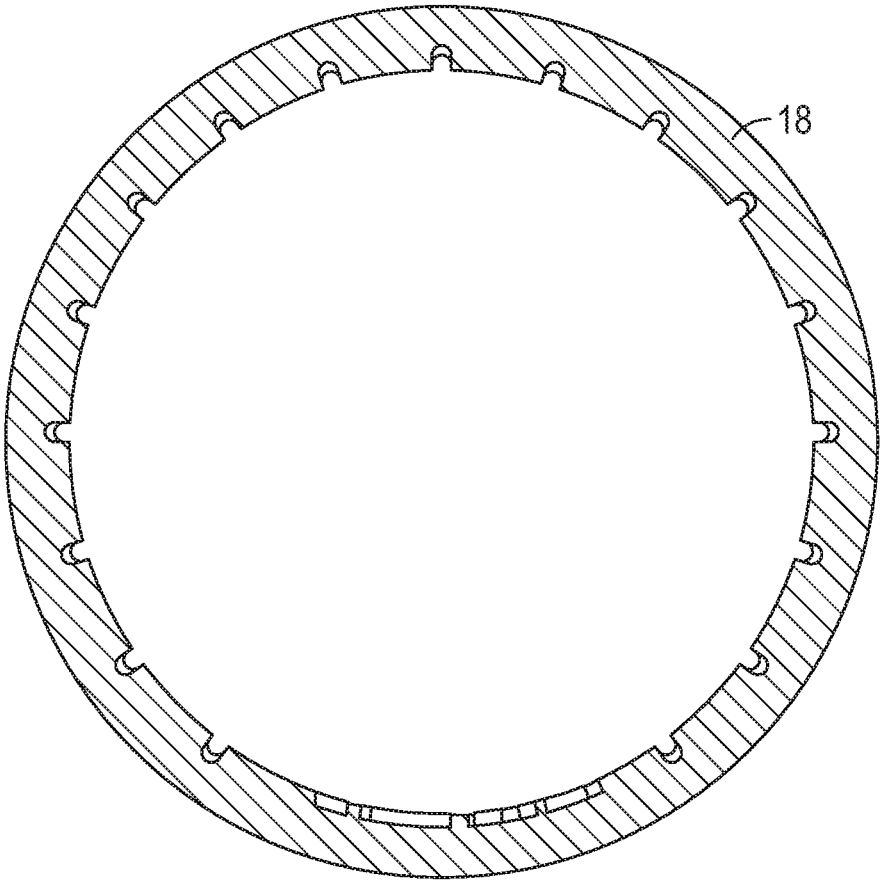
FIG. 6 is a cross-section of the breathable ring of FIG. 1 taken along line B-B of FIG. 4.

In each representative example shown in the drawings the grooves are seen to have a substantially semicircle cross-section when viewed along a direction parallel with the axis of revolution of the toroid (as seen in FIG. 6) and to have a longest length that is substantially parallel with the axis of revolution of the toroid. An "axis of revolution" of a toroid is defined herein as an axis about which an area may be revolved to fully form the shape of the toroid. The mentioned area is the cross-section which may be, by non-limiting example, an ellipse, circle, etc., as described previously. The axis of revolution, accordingly, does not pass through the toroid in the sense that no portion of the toroid touches the axis.

The longest length of each groove is not exactly parallel with the axis of revolution of the toroid because each groove has a curved configuration due to the curved nature of the inner surface of the ring. Nevertheless, in all implementations shown in the drawings the longest lengths of the grooves are substantially parallel, though not collinear, with the axis of revolution of the toroid. As used herein, the term "substantially parallel" as it relates to the grooves relative to the axis of revolution of the toroid is meant to convey that at least 80% of the longest length of each groove is less than 30 degrees offset from the axis of revolution of the toroid, and this is the case with the grooves shown in the drawings. Apart from being substantially parallel, it is also correct to say that each of the grooves is coplanar with the axis of revolution of the toroid, inasmuch as each groove fully lies in a plane in which the axis of revolution also fully lies. This is not to say that the grooves are all coplanar with one another, there may be some grooves that are coplanar with one another but each individual groove will lack coplanarity with most of the other grooves—but each groove is individually coplanar with the axis of revolution.

In implementations there could be other numbers of grooves and/or they could be spaced differently and/or they could take on other shapes and positions. By non-limiting example, there could be any number of grooves greater than, or less than, seventeen (17). The image could be omitted and there could be grooves placed in that location, and the spacing between all grooves could be such that each groove is equidistant, or substantially equidistant, from its nearest neighboring grooves. Or, in other implementations, one or more grooves could be present at the location of the image notwithstanding this affecting the appearance of the image. In other implementations the grooves could be spaced using some other regular, irregular, or complex pattern.

Although the grooves could be spaced irregularly, or using some complex pattern, it is to be understood that there are advantages to equally spaced grooves. Relatively equidistant grooves can be useful to ensure that the ability for moisture, dirt, and the like to exit is equally distributed across the inner surface. Accordingly, with relatively equidistant grooves, regardless of where moisture, dirt, grime, or the like is located between the ring and the digit of the user, it will always be near a groove so that its extraction is more likely. On the other hand, non-equidistant grooves may result in some areas being less likely to extract moisture, dirt, etc., and other areas being more likely to extract such elements, based on the higher concentration of grooves in some area and the lower concentration of grooves in another area. Thus, equidistant or relatively equidistant grooves are useful for having an evenly distributed capability to extract moisture, dirt, etc. Relatively equidistant grooves also have an aesthetically pleasing appearance.

The grooves in the representative examples have substantially semicircular cross-sections when viewed along a direction parallel to the axis of revolution of the toroid, as seen in FIG. 6. In other implementations they could have other cross-sections, such as square or substantially square, rectangular or substantially rectangular, triangular or substantially triangular, semi-oval or substantially semi-oval, semi-elliptical or substantially semi-elliptical, semi-polygonal or substantially semi-polygonal (including regular or irregular polygons having any number of sides), and any other regular or irregular shape. Although these shapes are not shown in the drawings, the practitioner of ordinary skill in the art will be able to easily envision and incorporate such cross-sections without the need for them to be explicitly depicted in the drawings.

The grooves in the drawings are seen to exist only on the inner surface of the ring. In other implementations outer grooves, having any configuration described herein for the inner grooves, could exist on the outer surface. Such outer grooves could be aligned or offset from the inner grooves, and could meet with the inner grooves (such that each groove itself completely circumscribes the ring 2) or the inner grooves and outer grooves could stop at the top and bottom of the ring so as to not interconnect.

The grooves of ring 2 increase the breathability of the ring. By "breathability" is meant the ability of the grooves to allow moisture, air, particulates, etc., to pass from one end of the ring (top or bottom) to the other (bottom or top), and/or to pass from inside a groove to outside a groove, along the inner surface or along the digit of a user, by passing through the groove. For example, for an athlete, worker, or other person wearing the ring, perspiration, dirt, grease, oil, water from washing/bathing, rain, water from aquatic sports, and other items collecting near the ring may pass through the grooves and not collect in excess around the ring or between the ring and the digit of the user. This may help to ensure that the ring does not become overly slippery—or otherwise that a desired friction between the ring and the digit of the user does not become too low—so that the ring does not slip off the digit of the user. It may also prevent moisture from remaining for long periods between the digit and the ring, thus reducing the likelihood of bacterial growth. Allowing dirt and other items to pass through the grooves may also ensure that the user's digit is not chafed, abraded, scraped, cut, soiled, or agitated by the dirt, grease, grime, or other items.

The grooves may also slightly increase the expandability of the ring, further allowing the diameter and therefore the circumference of the ring (perpendicular to the axis of revolution of the toroid) to increase as needed to accommodate fluctuations in the circumference of the digit upon which the ring is being worn. For example, a person participating in an athletic or physically engaging activity may have increased blood flow to the digit on which the ring is worn, which may result in an increase in the circumference of the digit. Injury or spraining of a digit may result in swelling which may increase the circumference of the digit. Cold temperatures may slightly decrease the circumference of the digit while hot temperatures may slightly increase the circumference of the digit. Weight gain or weight loss of the user over a period of time may increase or reduce the circumference of the digit, respectively. In any of these scenarios the expandability of the ring due to the presence of the grooves may accommodate the variation in size of the digit while still allowing the ring to be worn comfortably and snugly around the digit. The expandability of the ring may be enhanced by the presence of the grooves due to the smaller cross-section along the direction of expansion at the groove locations. In addition to the expandability due to the grooves, the expandability of the ring in general is allowed by the low elastic modulus of one or more materials from which the ring is formed, which is discussed further below.

The grooves in the representative examples, as discussed above, are substantially parallel with the axis of revolution of the toroid and are coplanar with the axis of revolution of the toroid. In other implementations other configurations could be used. Some grooves could be included that are substantially perpendicular with the axis of revolution of the toroid and coplanar with a plane that is perpendicular to the axis of revolution of the toroid (these grooves could intersect with the grooves shown in the drawings, for example travelling along the inner surface of the ring and centered around the axis of revolution of the toroid). In other implementations grooves could be slightly offset from a substantially parallel configuration, such that each groove is at an angle relative to the axis of revolution of the toroid—in other words a somewhat rifled configuration. In still other implementations some grooves could be at a first angle relative to the axis of revolution and others could be at another angle relative to the axis of revolution, such that the grooves form an overlapping or interlacing X pattern (the opposite-angled grooves intersecting one another in crisscross manner). Each of the grooves shown in the drawings is seen to be straight (albeit curved due to the curved nature of the inner surface) along its full length from the bottom to the top of the ring. In other implementations the grooves could be wavy, curved in other directions than those shown in the drawings, and so forth. Any of the configurations and alternatives discussed herein for the grooves may be combined to form various additional/alternative configurations.

Although several types of groove configurations are described, it should be pointed out that there are advantages to having the simple, straight grooves shown in the drawings. One of these may be that, for manufacturing purposes, a ring with straight grooves may be more easily removed from a mold, though there are other useful reasons. Straight grooves allow moisture, dirt, etc., to have the shortest path of removal or extraction from between the ring and the digit of the user, whereas for other groove patterns such elements may have a longer path, and it may be more difficult for them to be extracted. For example, crisscross, wavy, and rifled patterns are described above for the grooves. Such patterns, since they involve grooves that are not substantially parallel with the axis of revolution of the toroid, require moisture, dirt, etc. to travel a longer distance to be extracted. Other patterns, such as patterns which have horizontal grooves (grooves perpendicular to the axis of revolution of the toroid) would result in some moisture, dirt, etc. getting in the horizontal grooves, and such elements would not be able to be extracted until they reach one of the vertical grooves (grooves substantially parallel with the axis of revolution). Accordingly, such a groove pattern may result in some moisture, dirt, etc., being more likely to stay trapped between the ring and the user's digit for a longer period of time. Moisture traveling from one side of the ring to another (for example from the top of the ring to the bottom of the ring or vice versa) between the ring and the digit may thus take a longer period of time to get through. The straight grooves shown in the drawings, which are substantially parallel with the axis of revolution of the toroid, and each of which is coplanar with the axis of revolution of the toroid, provide the shortest, quickest path for moisture, dirt, etc., to be removed from between the ring and the digit. Additionally, the straight grooves provide a simple, aesthetically pleasing design.

It should also be pointed out that the ideal fit of the ring is a fit in which not all of the inner surface is contacting the digit (particularly, there would not be contact at the grooves). This allows air to pass through the grooves, and the air facilitates or aids the removal of moisture, dirt, etc. This allows the area between the ring and digit to more quickly reach a clean, dry state. Often, when drying their hands or feet after washing them, or after swimming or sweating during an athletic activity, users do not move the ring during the drying process, and so some moisture or the like gets temporarily trapped between the ring and the digit. With the rings disclosed herein the user does not have to move the ring to fully dry the digit—instead the air that flows through the grooves allows a user's digit to quickly dry even without moving the ring to manually dry all of the digit.

It is also noted that some users appreciate a tight, snug fit for a ring. For such users, the ability to dry the area underneath a ring may be particularly difficult because the ring may be difficult to move in order to fully complete the drying process. The rings disclosed herein, however, allow for the easy drying of such areas even if the ring is snug on the user's digit. The ring does not need to move to accommodate the fully and quick drying of the digit because the grooves will provide space between the ring and the digit and will allow air flow even if the ring, in general, is tight. Thus, the evaporation or otherwise removal of moisture is accelerated due to the grooves.

It has also been observed, by at least one purchasing consumer, that the ring allows moisture and the like to escape better than the ring of a competitor which uses wavy, semi-horizontal grooves (which competitor ring is disclosed in an information disclosure statement filed herewith). The consumer indicated in a post to the inventors' website dated May 25, 2017: "Ordered this and a set of [competitor] at the same time . . . Ring fits true to size ([the competitor ring] did not). Enso Elements really does let moisture out. Enso kept my finger dry under ring better than [the competitor ring] (which may [be] because [the competitor ring] was a bit too small?)." While the consumer at least partially attributed the sizing to the ability of the ring to let moisture out, it is believed by the inventors that the specific nature of the grooves—i.e., straight grooves giving moisture the quickest and easiest exit—also helped to let moisture out quicker.

The ability of the breathable rings 2/28 to achieve a good fit that is not too tight but which is still snug, partially through the expandability and the presence of the grooves, also reduces irritation and discomfort. Rings that fit too tightly can cause chafing, abrasion, irritation, and so forth, and as pointed out by the above quoted consumer they may also reduce the ability of moisture to escape from beneath the ring.

Figure 4:
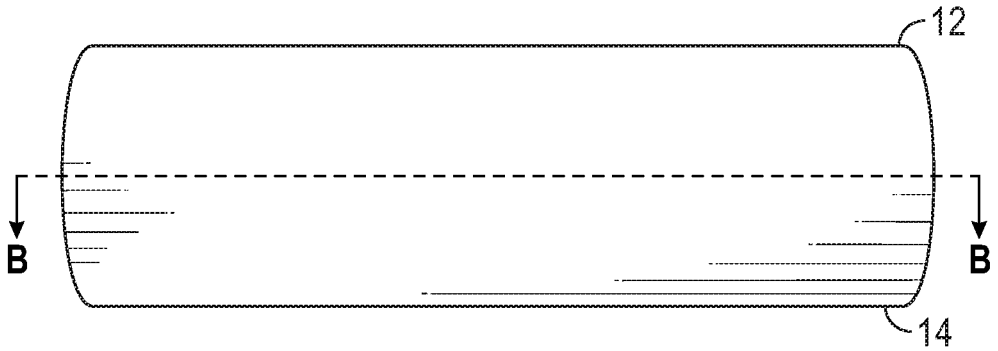
FIG. 4 is a left side view of the breathable ring of FIG. 1, the front, right, and rear side views being mirror images.
Figure 5:
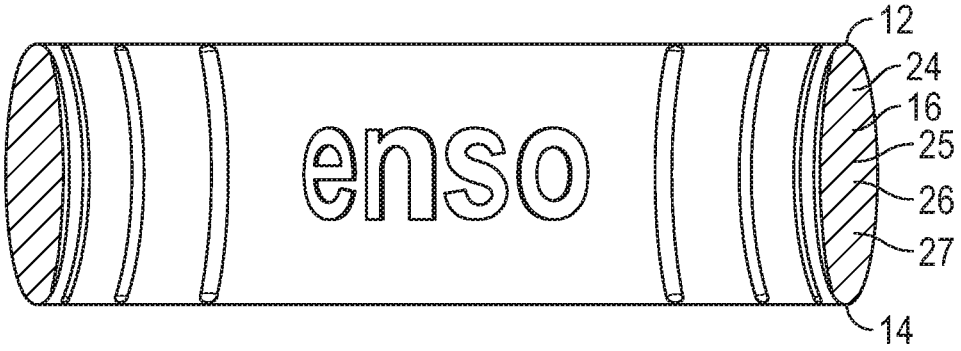
FIG. 5 is a cross-section of the breathable ring of FIG. 1 taken along line A-A of FIG. 3.

In FIG. 6 the ring is seen to have a circular cross-section 18 taken along line B-B of FIG. 4. In other implementations the ring could have other cross-sections along this direction, but as the ring is intended as an item of jewelry for the digit of a user, in most implementations the ring will have a circular or substantially circular cross-section along this direction.

The ring in implementations is formed of an expandable material 24 which is a polymer 25, and in the representative examples shown in the drawings the expandable material is silicone. In other implementations the expandable material could be a rubber, an elastomer, an elastic polymer, and so forth. While the terms "expandable" and "elastic" are terms of degree—in other words all materials including metals, ceramics, intermetallics, composites, etc., have some elasticity and expandability—the term "expandable material" as used herein is defined as "a material having an elastic modulus (Young's modulus) at least as low as 5 gigapascals (GPa)." In other implementations the elastic material may have an elastic modulus at least as low as 1 GPa, or at least as low as 0.1 GPa, or at least as low as 0.01 GPa. In other implementations the elastic material may have an elastic modulus as least as low as that of silicone. In other implementations the elastic material may have an elastic modulus as least as low as that of rubber. Rings made of silicone may have any properties and/or may be made using any techniques that are known in the art for silicone.

The relatively low elastic modulus of the elastic material (compared, for example, with metals from which rings are commonly formed—which have elastic moduli on the order of tens (10s) or hundreds (100s) of GPa) allows for the ring to repeatedly undergo elastic deformation to accommodate fluctuations in the digit circumference without undergoing plastic (permanent) deformation at levels of strain at which other materials (including metals) would undergo plastic deformation.

The expandability of the ring also enhances its safety. In some settings a metallic ring may increase the likelihood of a digit being injured or even severed from a user's hand. Some work environments preclude the use of metallic jewelry, and in some work or sporting environments (such as mechanics or contact sports) the use of metallic jewelry on a digit increases the likelihood of injury to the user or others. In such cases the expandable nature of the ring may prevent a user's digit from being injured or severed and/or may prevent other injuries to the user or others. In other implementations the relatively lower shear strength of the expandable material (compared to metals, for instance), allows for the ring itself to be sheared at a lower force than that which would injure or shear a user's digit, so that the ring may shear while preventing injury to the user or another person. While the shearing of an item of jewelry is generally undesirable, it is of course preferred to the shearing or serious injury of a finger or toe or some other serious injury to the user or others.

In implementations the ring includes antimicrobial elements (antimicrobial particles) 26. Element number 26 shown in FIG. 5 simply points to the interior of the elastic material, and this is meant to convey the idea that the entire expandable material from which the ring is formed may have antimicrobial elements interspersed throughout. Some of these antimicrobial elements would thus be entirely comprised in an interior of the ring while some of them may be exposed on the outer and inner surfaces (and top and bottom) of the ring. This could be accomplished, by non-limiting example, by mixing a powdered antimicrobial element into a liquid resin or melted polymer, the liquid resin or melted polymer then being formed into the shape of the ring and solidified so that the antimicrobial elements are locked in place in an interspersed configuration in the solidified ring. In other implementations the antimicrobial elements could only be present at an exterior of the ring, such as on the inner and outer surfaces and on the top and bottom. This could be accomplished by adhering a fine coating of a polymer, a resin, a composite, a metal, or some other material, including the antimicrobial elements, on the exterior of the ring. An antimicrobial coating in some implementations could be water or solvent based and could be a coating marketed under the trade name STERITOUCH by Steritouch LTD. of Abertillery, Gwent, Wales.

In all of the implementations shown in the drawings the antimicrobial elements are not just applied as a coating but are interspersed throughout the expandable material and include ionic silver particles marketed under the trade name STERITOUCH by Steritouch LTD. In implementations the ionic silver particles are larger than the nanometer-sized range—in other words having an average diameter larger than 100 nanometers (nm). The practitioner of ordinary skill in the art may choose to use an antimicrobial coating or to have antimicrobial elements interspersed throughout the ring according to a few factors, as described below.

Interspersing antimicrobial elements throughout the ring, either homogeneously or otherwise, allows the antimicrobial effect to not be diminished (or not greatly diminished) by scratches, cuts, nicks, etc., so that such a configuration is useful when the ring is used in a rougher environment. On the other hand, if a ring is not used in a rough environment (but, for example, in a wet environment such as a sweaty athletic activity, swimming, etc.), using an antimicrobial coating instead of interspersing antimicrobial particles throughout could reduce the number of antimicrobial particles which need to be used on each ring by concentrating the particles at the external surfaces of the ring, which may reduce material costs but which will add a coating step (as opposed to the antimicrobial particles being added during a mixing step). It is pointed out here that the "exterior surfaces" of the ring include the inner surface, the outer surface, the top, and the bottom of the ring—basically all portions of the ring that are visible to the user without cutting or severing the ring.

It is also true that, in some implementations and under some conditions, antimicrobial particles sold under the trade name STERITOUCH may be configured to migrate generally towards the surfaces of an item during processing and/or curing, so that there may be a somewhat higher concentration of antimicrobial particles at or near the surfaces of the ring after the curing process, though with antimicrobial particles still present and interspersed throughout the ring. Such a configuration may allow for concentrating antimicrobial effects at or near the surface of the ring without adding a coating step, and may reduce the number of antimicrobial particles that need to be used, though with the potential of reduced antimicrobial effect at the presence of deeper cuts/nicks in the ring. Accordingly, the specific configuration may be chosen by the practitioner of ordinary skill in the art to achieve the desired balance of benefits. It is also pointed out that there may be a similar mechanism at play with precious material particles (which particles are described in more detail later), whereby they tend to migrate towards the surfaces of the ring during curing.

For the purposes of this disclosure, a distribution of particles (precious material particles or antimicrobial particles) which includes particles present at all exterior surfaces of the ring, and which may include a higher concentration of particles at or near the external surfaces, but which also includes a non-zero concentration of particles interspersed throughout all depths of the ring between the inner surface and outer surface and between the top and bottom of the ring, is defined as a "substantially even distribution." For purposes of distinction and measurement, a distribution which includes a concentration of zero particles at any depth within the ring (for example zero particles at a depth located centrally between inner surface and outer surface) would not have a "substantially even distribution" of those particles. As another example, a ring which has a zero concentration of particles at a depth of 1 millimeter (mm) from the inner surface of the ring would not have a "substantially even distribution" of those particles within the ring.

The antimicrobial elements prevent or slow down the formation of bacteria and microbes on the exterior and/or even in the interior of the ring. This has obvious health benefits. It may also ensure that the ring does not acquire an unpleasant odor even though continuously subjected to sweat, dirt, grime, moisture, and the like. Experiments were conducted on the ring material with added antimicrobial elements and the antimicrobial elements were shown to provide an effective reduction of microbial growth.

In one experiment three samples of ring material having 1% of a mixture including antimicrobial elements achieved greater than a 99.99992% reduction of *Escherichia coli* (*E coli*) colony forming units (CFUs), tested at 35 degrees Celsius at 0 and 24 hours, compared with a control sample of an untreated polyethylene film. The control sample and the three samples of ring material began with 100,000 CFUs at 0 hours, and at 24 hours the control sample had 13,000,000 CFUs while the three ring material samples had under 10 CFUs. These tests were performed according to the ISO 22196/JIS Z 2801:2000 standard.

In another test, one sample of ring material having 1% of a mixture including antimicrobial elements achieved greater than a 99.99991% reduction of *Escherichia coli* (*E coli*) colony forming units (CFUs), tested at 35 degrees Celsius at 0 and 24 hours, compared with a control sample of an untreated polyethylene film. The control sample and the sample of ring material began with 160,000 CFUs at 0 hours, and at 24 hours the control sample had 12,000,000 CFUs while the ring material sample had under 10 CFUs. This test was also performed according to the ISO 22196/JIS Z 2801:2000 standard.

In another test, one sample of ring material having a 1% mixture including antimicrobial elements achieved greater than a 99.995% reduction of methicillin resistant *Staphylococcus aureus* (MRSA), tested at 35 degrees Celsius at 0 and 24 hours, compared with a control sample of an untreated polyethylene film. The control sample and the sample of ring material began with 220,000 CFUs at 0 hours, and at 24 hours the control sample had 240,000 CFUs while the ring material sample had under 10 CFUs. These tests were also performed according to the ISO 22196/JIS Z 2801:2000 standard.

The rings may include one or more types of precious material particles. FIG. 1 shows, for example, precious material particles 27. While the lead line in the drawing simply points to the exterior surface of the ring, it is to be understood that the precious material particles have a substantially even distribution throughout the ring (though in other implementations the precious material particles could be added mainly to the exterior as a coating, such as with a paint or the like). FIG. 5 shows that there are precious material particles 27 in the interior of the ring. The precious material particles are not individually shown in FIG. 1 or 6 since they are in powdered form when added to the ring and their size is such that each particle may not be individually visible to the naked eye upon inspection.

The precious material particles may include a precious metal or a precious non-metal material. Non-limiting representative examples of precious materials include: powdered gold particles; powdered non-ionic silver particles; powdered copper particles; powdered platinum particles; powdered/crushed pearl particles; and so forth. The precious material particles may have any particle size and may have any distribution throughout the toroid or on or in the toroid as is described above for the antimicrobial particles, with corresponding benefits that may be balanced by the practitioner of ordinary skill in the art to achieve desired benefits.

The ring may include one or more colorants added to alter the appearance or hue of the ring. The colorant could be added as a coating after the ring is molded—such as a paint or the like—or the colorant could be mixed in prior to molding. In the examples shown in the drawings the colorant is not specifically pointed to because the colorant is homogeneously interspersed throughout the ring so that it is visible in all parts of the ring, exterior and interior. There are advantages of each approach. An after-molding coating may reduce material costs due to less colorant being needed but adds a coating step (as opposed to integrating the coloring step with the mixture step) and the coating may be liable to be worn off or scratches may tend to reveal the underlying color. On the other hand, using colorant in the mixing step may increase material costs, but removes the coating step (instead integrating the coloring step with the mixing step), and if the ring gets nicked, scratched, or the like, the color of the ring at the location of the nick, scratch, etc. will be the same as that on the exterior of the ring surrounding the affected area. Accordingly, the practitioner of ordinary skill in the art may consider the benefits of each option and balance the benefits as desired. In the representative examples shown in the drawings the colorants are formed of proprietary blends and are homogeneously mixed with the polymer material prior to curing.

Various colors are achievable through the proprietary blends, though the practitioner of ordinary skill in the art may achieve various colors by selecting available colorants from known providers. In implementations the ring may have any color or combination of colors by use of the colorants. In implementations the colorant may have a color matching a color of the precious material particles. For example, a ring having gold particles may also include a gold-colored colorant, a ring having non-ionic silver particles may also include a silver-colored colorant, a ring having copper particles may also include a copper-colored colorant, a ring having platinum particles may also include a platinum-colored colorant, a ring having powdered or hydrolyzed pearl particles may also include a pearl-colored or pearlescent colorant, and so forth. In some cases the ring may have a metallic look due, in part, to the colorant. The colorant may include actually shiny particulates interspersed throughout to add a shine or glimmer to the ring. In some implementations the precious materials are not actually visible, or are nearly not visible, and the color of the ring and/or the metallic shine, luster, etc., is due entirely, or in large part, to the colorant.

On the other hand, a colorant could simply be applied to the external surfaces of the ring, as disclosed above. In implementations a coating could be used to give the silicone (or other expandable material) ring a metallic appearance. This could be done using a metallic-colored lacquer or paint applied to the exterior of the ring to give the ring an appearance of a metal (copper, gold, silver, platinum, tungsten, titanium, etc.). In implementations this coating could also include the antimicrobial elements (by non-limiting example, a lacquer coating having actual silver particles may impart a silver appearance to the exterior of the ring while simultaneously providing some ionic silver for antimicrobial properties).

But, in the cases shown in the drawings wherein the colorant is evenly distributed throughout the ring, the copper, gold, silver, or other metallic or other colored appearance exists at all external surfaces and throughout the entire cross-section of the ring. The example colors and the example color/precious material matches given herein are only examples and others are possible. In some implementations the precious material and the colorant do not match, for example one implementation of a ring has a turquoise colorant and silver particles for the precious material. Naturally, colorants in many forms (powdered, liquid, etc.) and coloring techniques for polymers in general exist in the art may be used to color the rings. The colorants used for the rings in the drawings include powdered pigments. The colorants may also include shiny particles to add shine or luster. Precious materials in powdered form are also available from known suppliers and the practitioner of ordinary skill in the art may select appropriate precious materials, colorants, and particle sizes for each as desired.

In the instance wherein a colorant has a color matching the color of the included precious material, the colorant serves a useful function in that indicates to the user the precious material that is included in the ring, which precious material may not be visible or may not be easily visible to the user.

The image 20 that is representatively illustrated in the drawings is a brand name. In implementations the image could alternatively or additionally include other elements, such as the initials or name of a person, an inspirational phrase, or the like. Alphanumeric characters, logos, and non-text/non-numeric images could be used as well.

Various manufacturing techniques may be used to form the ring such as, by non-limiting example, compression molding and/or injection molding. Other manufacturing techniques may be used. In the representative examples shown in the drawings the ring is a compression molded ring.

The ring implementation shown in FIGS. 1-6 is a men's size 11 ring. The implementation shown in FIGS. 7-8 is a women's size 10 ring and has similarly named elements having similar characteristics to the ring elements described above for ring 2.

Figure 7:
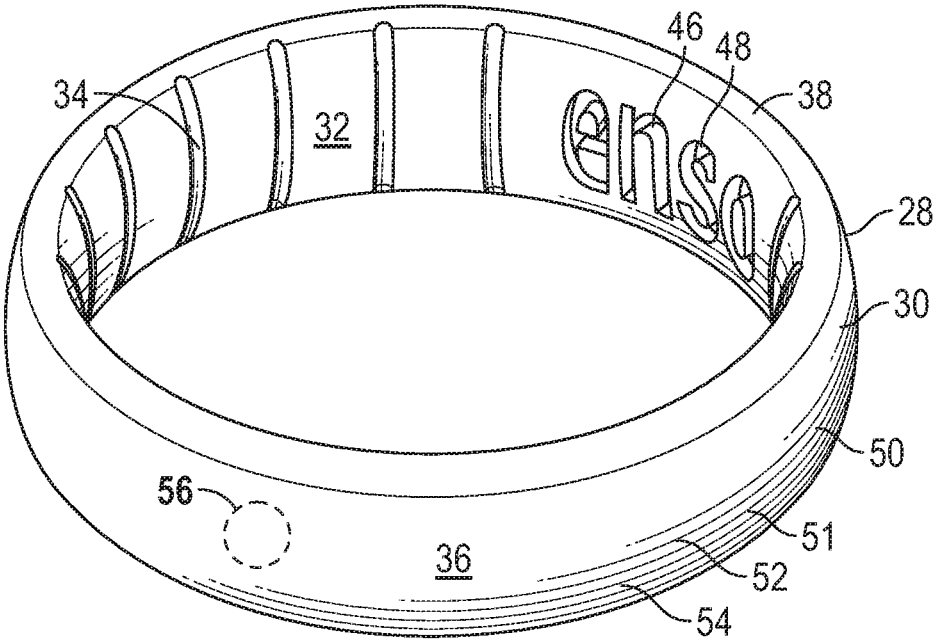
FIG. 7 is a front perspective view of another implementation of a breathable ring.
Figure 8:
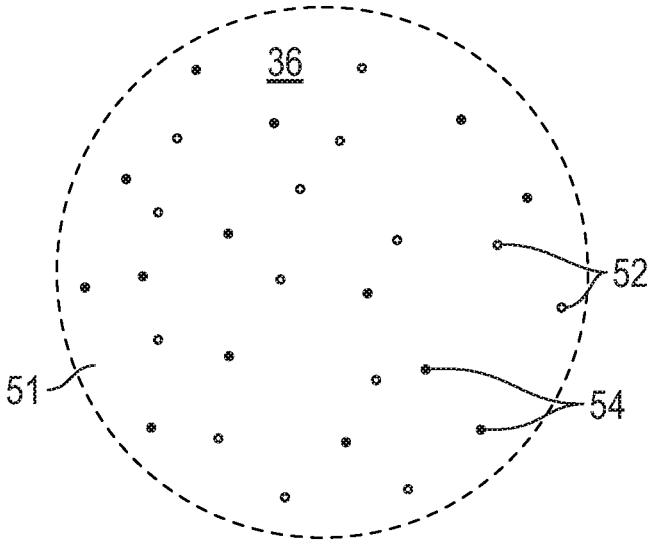
FIG. 8 is an exaggerated magnified view of area 56 of the surface of the breathable ring of FIG. 7.

For example, breathable ring (ring) 28 of FIGS. 7-8 is formed of a toroid 30. The ring/toroid has an inner surface 32 with grooves 34, an outer surface 36, a top 38 and a bottom (not seen in the drawings but the bottom of ring 28 is similar to bottom 14 of ring 2), an elliptical cross-section (not seen in the drawings but the elliptical cross-section of ring 28 is similar to elliptical cross-section 16 of ring 2), a circular cross-section (not seen in the drawings, but the circular cross-section of ring 28 is similar to circular cross-section 18 of ring 2), and an image 46 on the inner surface which is an inscription 48 in the representative example. The ring is formed of an expandable material 50 (which is a polymer 51) and includes antimicrobial elements 52 (antimicrobial particles). Accordingly, apart from its size (and/or its relative dimensions), ring 28 it is relatively similar to ring 2 described above.

Other sizes and shapes than those shown in the drawings are possible. Women's rings of any size range (including but not limited to sizes 4-10), men's rings of any size range (including but not limited to sizes 7-14), children's rings of any size range, and the like, may be formed and may include any of the properties described above for rings 2 and 28.

Various designs could be implemented at the exterior (including inner and outer surfaces) of the ring. Some rings could have a rougher appearance/exterior, and others may have a smoother appearance/exterior. One or more images and/or designs could be included on the outer surface of the ring. Grooves on the outer surface of the ring, or inscriptions, could be included for aesthetic design and/or for functional purposes. Other configurations are possible.

Ring 28 is seen in FIG. 7 to have precious material particles 54, and area 56 of FIG. 7 is shown magnified in FIG. 8, magnified to a magnification sufficient to reveal the precious material particles and antimicrobial elements/particles. FIG. 8 reveals a representative example of a homogeneous distribution of precious material particles and antimicrobial particles at the magnification site on the outer surface 36 of the ring which are interspersed within the polymer 51. The magnification needed to reveal individual particles may be much greater than the scale shown in FIG. 8 but the particle sizes are exaggerated for ease of viewing. For any of the rings disclosed herein the precious material particles and the colorants may have any distribution, including a substantially even distribution, a homogeneous or even distribution, and so forth, as is described above for the antimicrobial particles, with corresponding benefits that may be considered by the practitioner of ordinary skill in the art when determining which distribution to use.

A representative example of processing steps is as follows. In implementations the silicone portion of the ring is formed using a two-component resin mixture (hereafter called components A and B). Components A and B are both transparent liquids and are mixed together, the mixing beginning a curing process. While the mixture is still liquid a number of proprietary colorants are added to achieve any desired color and optical properties including shine and luster, the antimicrobial particles are added, and precious material particles are added. The mixture is mixed using a speed mixer until all elements are evenly distributed. The mixture is then compression molded into the shape of the ring and kept in the mold until the curing process is completed. The compression mold has a polished finish so that the rings come out having a smooth exterior surface (despite this the grooves, the snug fit, and/or the coefficient of friction between the ring and the digit may prevent the ring from undesirably sliding or rotating on the digit). The grooves and the "enso" logo in the representative examples are formed by the mold which has these shapes built in. After removal from the mold any excess material may be removed.

Weight percentages of the components of the rings may be modified as desired. Since, during the curing and molding process, the moisture content of the polymer may be modified, initial weight percentages of the polymer may be slightly off from the final cured weight percentages. Nevertheless, in the cured state in implementations the silicone or other expandable polymer may form at least 80 percent, at least 85 percent, at least 90 percent, or at least 95 percent of the weight percentage of the ring/toroid. Varying the amount of expandable polymer understandably varies the expandability of the ring. In cured form in implementations the antimicrobial particles may form between 0.05 and 5.0 weight percent, or between 0.5 and 1.5 weight percent, of the ring/toroid. Varying the number of antimicrobial particles understandably varies the antimicrobial properties of the ring as well as the material costs. In cured form in implementations the precious material particles make up between 0.1 and 5.0 weight percent, or between 0.1 and 1.0 weight percent, or between 0.3 and 0.6 weight percent, or between 0.4 and 0.5 weight percent of the ring/toroid. Varying the amount of precious material particles may vary the appearance, weight, and material cost of the ring. It should be pointed out that increasing the amount of precious material in the ring may make the ring more desirable to a user because, among other things, it can increase the resale value of the ring.

Any of the rings disclosed herein may be formed without including any antimicrobial particles.

Figure 9:
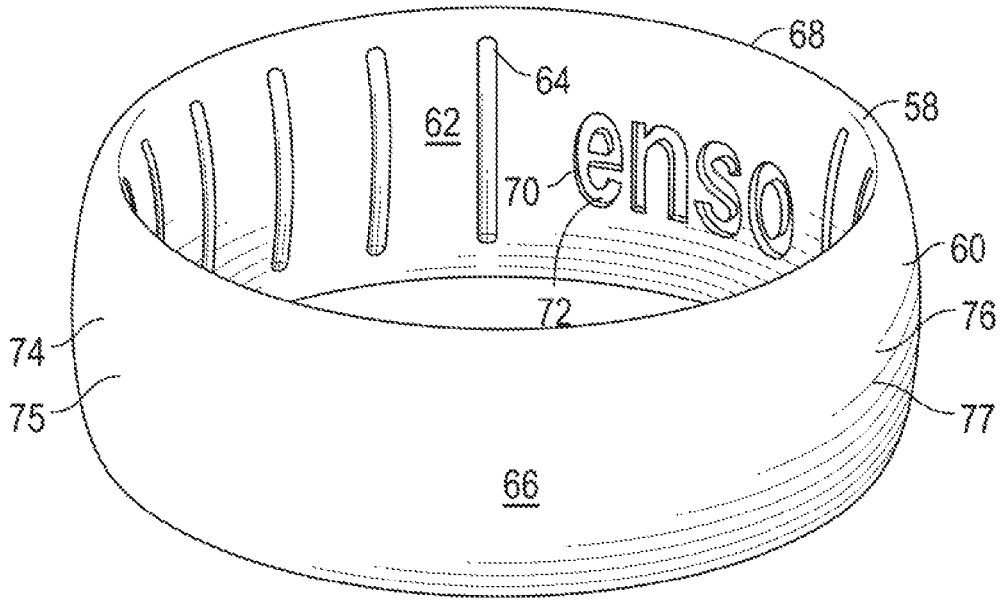
FIG. 9 is a front perspective view of another implementation of a breathable ring.

In implementations of rings the grooves may not extend fully from top to bottom of the ring. By non-limiting example, FIG. 9 shows a representative example of a breathable ring (ring) 58 which has the shape of a toroid 60 having an inner surface 62 with a plurality of grooves 64 therein, an outer surface 66, a top 68, and a bottom (not numbered). The grooves may be seen to not extend fully from the top to the bottom of the ring, as opposed to the grooves of ring 2 which extend from top to bottom. This is done to change the aesthetic appeal of the ring—in some implementations the ring has a better look if the grooves do not extend fully to the top and bottom of the ring. It may be possible, however, that this results in some decrease in the amount of airflow/breathability in some rings, though in others the same level of breathability/airflow may be maintained even with the shorter grooves. The ring may in other ways be similar or identical, such as having an elliptical cross section and a circular cross section (for cross sections taken from different perspectives), an image 70 which may be an inscription 72, and so forth. The ring 58 may be formed of an expandable material 74, which may be a polymer 75, and in implementations may include antimicrobial elements (antimicrobial particles) 76 and/or precious material particles 77 as with other rings. Nevertheless, as with other rings, the antimicrobial particles and/or precious material particles may, in implementations, be excluded.

Figure 10:
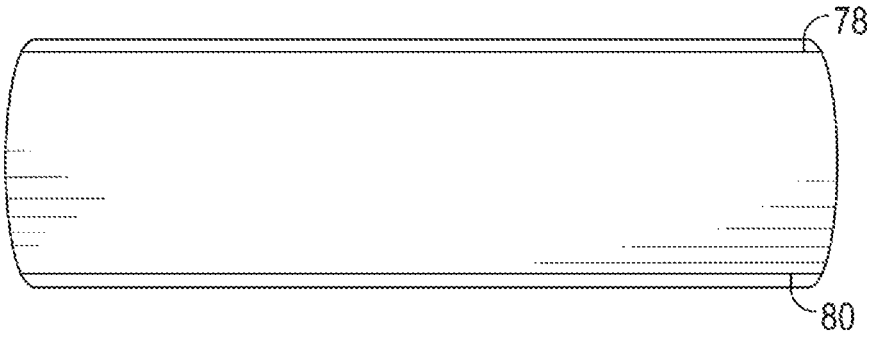
FIG. 10 is a left side view of the breathable ring of FIG. 9, the front, right, and rear side views being mirror images.

Ring 58 is also seen to be fully rounded at the top (it is also fully rounded at the bottom, though this is not visible in FIG. 9), as opposed to ring 2 which is flat at the top and bottom and has distinct, well-defined edges where the top and bottom meet the sides (inner surface and outer surface) of the ring. In some implementations the fully-rounded edges of the ring 58 have a 0.019 inch radius. Additionally, FIG. 10 shows an implementation of ring 58 which includes a parting line 78 (which in implementations is unavoidably created during the molding process) and a false parting line

80, which is intentionally added to be symmetrical with the parting line 78 so that there is one line towards the top and one towards the bottom of the ring. This increases aesthetic appeal of the ring.

Breathable rings may be made from polymers other than those disclosed herein, may be formed using manufacturing techniques other than those disclosed herein, may include precious materials other than those disclosed herein, may include colorants or colorant types other than those disclosed herein, and may include antimicrobial elements other than those disclosed herein. Those of ordinary skill in the art will readily be able to select appropriate materials, manufacturing techniques, and/or antimicrobial elements from the disclosures provided herein. The implementations listed here, and many others, will become readily apparent from this disclosure. From this, those of ordinary skill in the art will readily understand the versatility with which this disclosure may be applied.

In places where the description above refers to specific embodiments of breathable rings, one or more or many modifications may be made without departing from the spirit and scope thereof. Details of any specific embodiment/implementation described herein may, wherever possible, be applied to any other specific implementation/embodiment described herein.

What is claimed is:

1. A ring, comprising:

a toroid comprised of an expandable polymer, the expandable polymer comprising an elastic modulus of no greater than 5 gigapascals (GPa), the expandable polymer comprising at least 80 weight percent of the toroid, the toroid sized to fit snugly over a digit of a user;

a plurality of precious material particles disposed within the expandable polymer;

wherein the precious material particles comprise one or more of gold particles, non-ionic silver particles, copper particles, platinum particles, and crushed pearl particles; and one or more colorants disposed within the expandable polymer and visible at an exterior surface of the toroid, the one or more colorants comprising a color matching a color of the precious material particles, the one or more colorants not comprising the precious material particles;

wherein no portion of the ring is rigid.

2. The ring of claim 1, wherein the toroid comprises a substantially even distribution of the precious material particles interspersed throughout the toroid.

3. The ring of claim 1, wherein the ring further comprises shiny particles, wherein the shiny particles do not comprise the precious material particles.

4. The ring of claim 1, wherein the precious material particles comprise between 0.1 and 5.0 weight percent of the toroid.

5. The ring of claim 1, wherein the precious material particles are not visible to the naked eye.

6. The ring of claim 1, further comprising a plurality of grooves formed on an inner surface of the ring and extending from proximate a top of the ring to proximate a bottom of the ring.

7. The ring of claim 6, wherein, except for two grooves, each groove is equidistant from its two nearest neighboring grooves.

8. The ring of claim 6, wherein the grooves extend fully from the top of the ring to the bottom of the ring.

9. The ring of claim 1, wherein no portion of the ring comprises an elastic modulus greater than 5 GPa.

10. The ring of claim 1, wherein the ring does not comprise a jewel.

* * * * *